US006137974A

United States Patent [19]

Williams et al.

[11] Patent Number: 6,137,974

[45] Date of Patent: Oct. 24, 2000

[54] PHOTORECEPTOR BELT TENSIONER SYSTEM

[75] Inventors: Ernest B. Williams; Mark W. Horobin, both of Welwyn Garden City, United Kingdom

[73] Assignee: Xerox Corporation, Stamford, Conn.

[21] Appl. No.: 09/363,493

[22] Filed: Jul. 29, 1999

Related U.S. Application Data

[63] Continuation of application No. 09/363,782, Jul. 29, 1999

[60] Provisional application No. 60/113,021, Dec. 7, 1998.

[51] Int. Cl.[7] ..... G03G 15/00

[52] U.S. Cl. ..... 399/165; 198/810.04

[58] Field of Search ..... 399/165; 198/810.04, 198/816; 474/109, 110

[56] References Cited

U.S. PATENT DOCUMENTS 4,206,994 6/1980 Silverberg et al. ..... 198/810.04

5,641,058 6/1997 Merten et al. ..... 198/810.04

5,708,924 1/1998 Shogren et al. ..... 399/116

5,717,984 2/1998 Wong ..... 399/165

FOREIGN PATENT DOCUMENTS 401310125A 12/1989 Japan .

*Primary Examiner*—Arthur T. Grimley

*Assistant Examiner*—Remmon R. Fordé

*Attorney, Agent, or Firm*—William A. Henry, II; William Eipert

[57] ABSTRACT

A tensioning system that precisely sets and monitors tension in a photoreceptor belt and includes a stepper motor that is actuated by a controller to apply pressure to the photoreceptor belt through a roll over which the belt is mounted. A load cell is positioned with respect to a piston actuator to sense the pressure applied by the piston actuator against the photoreceptor belt and signals the controller which in turn actuates the stepper motor to bring the tension on the belt to a predetermined set amount.

2 Claims, 2 Drawing Sheets

PHOTORECEPTOR BELT TENSIONER SYSTEM

Cross-reference is hereby made to copending and commonly assigned U.S. Provisional Application No. 60/113,021 filed Dec. 21, 1998 and U.S. application Ser. No. 09/363,782, filed on Jul. 29, 1999, and entitled Closed Loop Photoreceptor Belt Tensioner by Daniel Constanza et al.

BACKGROUND OF THE INVENTION

The present invention relates generally to an electrostatographic printing machine, and more particularly, concerns improving color registration of images on a flexible photoreceptor within such a machine.

Flexible electrostatographic imaging members are well known in the art. Typical electrostatographic imaging members include, for example, photoreceptors for electrophotographic imaging systems and electroreceptor such as ionographic imaging members for electrographic imaging systems. These imaging members generally comprise at least a supporting substrate layer and at least one imaging layer comprising thermoplastic polymer matrix material. The "imaging layer" as employed herein is defined as the dielectric imaging layer of an electroreceptor or the photoconductive imaging layer of a photoreceptor. In a photoreceptor, the photoconductive imaging layer may comprise only a single photoconductive layer or a plurality of layers such as a combination of a charge-generating layer and a charge transport layer.

Although the discussions hereinafter focus only on flexible electrophotographic imaging members, nonetheless the problems encountered therewith are equally applicable to electrographic imaging members.

Generally, in the art of electrophotography, the process of electrophotographic copying is initiated by exposing a light image of an original document onto a substantially uniformly charged photoreceptive member. Exposing the charged photoreceptive member to a light image discharges a photoconductive surface thereon in areas corresponding to non-image areas in the original document while maintaining the charge in image areas, thereby creating an electrostatic latent image of the original document on the photoreceptive member. This latent image is subsequently developed into a visible image by depositing charged developing material onto the photoreceptive member surface such that the developing material is attracted to the charged image areas on the photoconductive surface. Thereafter, the developing material is transferred from the photoreceptive member to a receiving copy sheet or to some other image support substrate, to create an image, which may be permanently affixed to the image support substrate, thereby providing an electrophotographic reproduction of the original document. In a final step in the process, the photoconductive surface of the photoreceptive member is cleaned with a cleaning device, such as elastomeric cleaning blade, to remove any residual developing material which may be remaining on the surface thereof in preparation for successive imaging cycles.

The electrostatographic copying process described hereinabove, for electrophotographic imaging, is well known and is commonly used for light lens copying of an original document. Analogous processes also exist in other electrostatographic printing applications such as, for example, digital laser printing where a latent image is formed on the photoconductive surface via a modulated laser beam, or ionographic printing and reproduction where charge is deposited on a charge retentive surface in response to electronically generated or stored images. One of the drawbacks to the above-described process utilizing a flexible imaging member belt is that the belt, photoreceptor belt in particular, stretches during repeated use. This is due to the machine belt module design employing a number of backer bars and small diameter belt support rollers to support the photoreceptor belt for movement during electrophotographic image processing cycles and keeping the belt under tension at all times. The constant tension on the photoreceptor belt, the positioning of the backing bars, and the positioning of the small diameter rollers causes substantial belt fatigue through bending stress/strain build-up in the charge transport layer, promoting the onset development of premature charge transport layer stretching and cracking as a result of repetitions of the photoreceptor belt flexing over the small diameter belt support rollers and backer bars during machine cyclic photoreceptor belt function. Hence, stretching of the photoreceptor is considered to lead to mechanical failure as well as a significant source of misregistration of color images during image-on-image printing. Therefore there is a need for a photoreceptor belt tensioning system that achieves superior color registration while reducing belt tension during belt steering actuations.

PRIOR ART

The following disclosure may be relevant to certain aspects of the present invention:

U.S. Pat. No. 5,708,924

Patentee: Daniel K. Shogren et al.

Issued: Jan. 13, 1998

U.S. Pat. No. 5,708,924 is directed to a customer replaceable unit that includes a corner and support structure for supporting a photoreceptor belt while it is packaged, shipped and inserted over drive and idler rolls in a machine. It prevents a machine operator from having to handle the belt itself and provides protection from extrinsic damage. A machine is described that includes backer bars for tensioning the photoreceptor belt during use.

SUMMARY OF THE INVENTION

Accordingly, pursuant to the features of the present invention, a closed loop control system is disclosed that precisely sets and monitors tension roll systems in photoreceptor belt modules to increase image-on-image color registration. The closed loop control system employs a tension sensor to monitor the tension in the photoreceptor belt and an actuator that applies pressure to a steering roll on which the photoreceptor belt is mounted in order to increase or decrease tension on the photoreceptor belt and thereby reduce belt fatigue and stretching.

BRIEF DESCRIPTION OF THE DRAWINGS

The foregoing and other features of the instant invention will be apparent and easily understood from a further reading of the specification, claims and by reference to the accompanying drawings in which:

Figure 1:
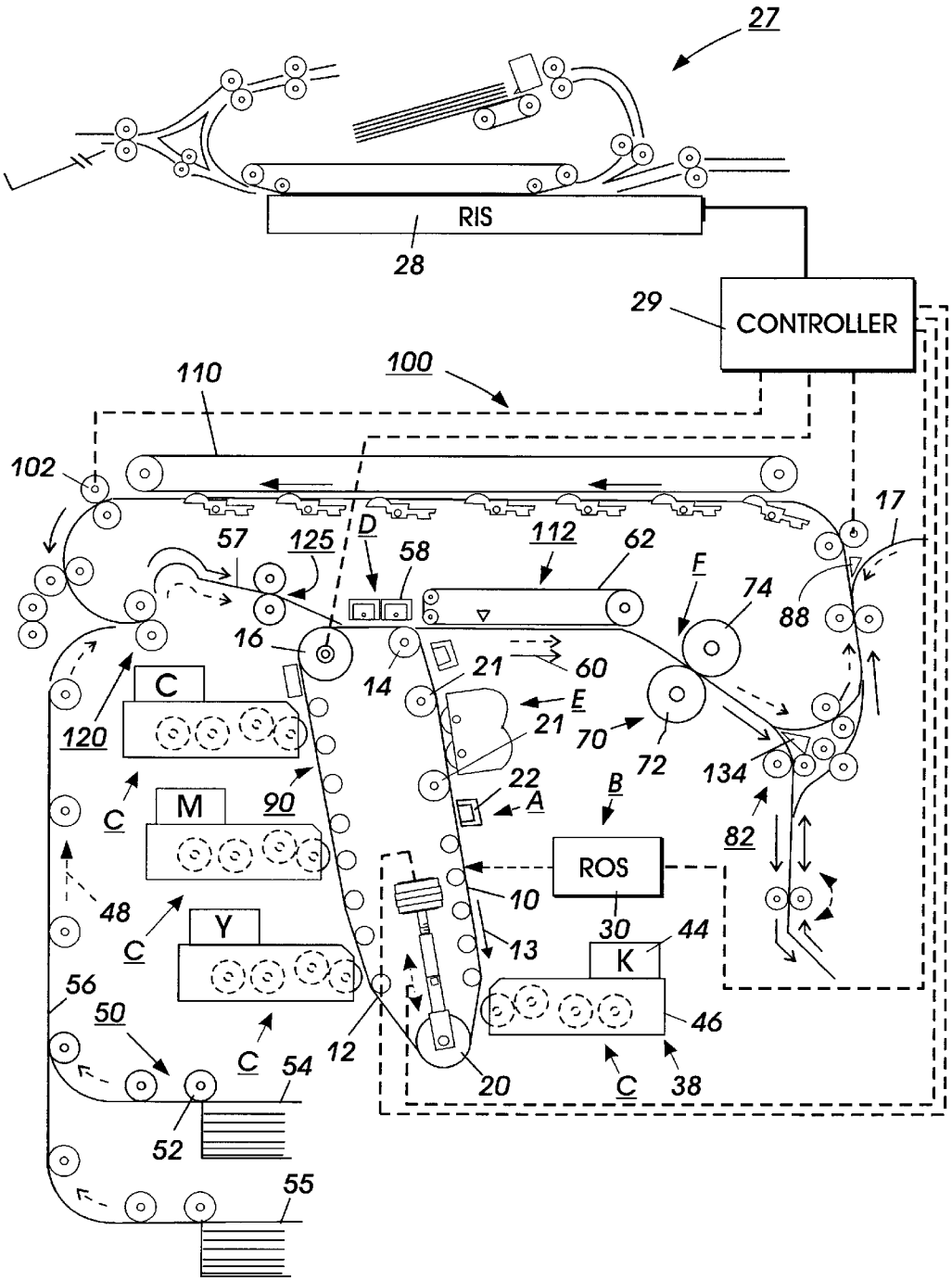
FIG. 1 is a schematic elevational view depicting the belt tensioning and detensioning scheme of the present invention in a printing machine.

All references cited in this specification, and their references, are incorporated by reference herein where appropriate for teaching additional or alternative details, features, and/or technical background.

While the present invention will be described hereinafter in connection with a preferred embodiment thereof, it should be understood that it is not intended to limit the invention to that embodiment. On the contrary, it is intended to cover all alternatives, modifications and equivalents as may be included within the spirit and scope of the invention as defined in the appended claims.

DETAILED DESCRIPTION OF THE INVENTION

For a general understanding of the features of the present invention, reference is made to the drawings. In the drawings, like reference numerals have been used through out to identify identical elements.

FIG. 1 schematically illustrates an electrophotographic printing machine which generally employs a photoconductive belt 10 mounted on a belt support module 90. Preferably, the photoconductive belt 10 is made from a photoconductive material coated on a ground layer which, in turn, is coated on an anti-curl backing layer. Belt 10 moves in the direction of arrow 13 to advance successive portions sequentially through the various processing stations disposed about the path of movement thereof. Belt 10 is entrained about stripping roll 14, drive roll 16, idler roll 21, and tensioning steering roll 20. As roll 16 rotates, it advances belt 10 in the direction of arrow 13.

Initially, a portion of the photoconductive belt surface passes through charging station A. At charging station A, a corona generating device indicated generally by the reference numeral 22 charges the photoconductive belt 10 to a relatively high, substantially uniform potential.

At an exposure station B, a controller or electronic subsystem (ESS), indicated generally be reference numeral 29, receives the image signals from RIS 28 representing the desired output image and processes these signals to convert them to a continuous tone or greyscale rendition of the image which is transmitted to a modulated output generator, for example the raster output scanner (ROS), indicated generally by reference numeral 30. Preferably, ESS 29 is a self-contained, dedicated microcomputer. The image signals transmitted to ESS 29 may originate from RIS 28 as described above or from a computer, thereby enabling the electrophotographic printing machine to serve as a remotely located printer for one or more computers. Alternatively, the printer may serve as a dedicated printer for a high-speed computer. The signals from ESS 29, corresponding to the continuous tone image desired to be reproduced by the printing machine, are transmitted to ROS 30. ROS 30 includes a laser with rotating polygon mirror blocks. Preferably a nine-facet polygon is used. The ROS 30 illuminates the charged portion on the surface of photoconductive belt 10 at a resolution of about 300 or more pixels per inch. The ROS will expose the photoconductive belt 10 to record an electrostatic latent image thereon corresponding to the continuous tone image received from ESS 29. As an alternative, ROS 30 may employ a linear array of light emitting diodes (LEDs) arranged to illuminate the charged portion of photoconductive belt 10 on a raster-by-raster basis.

After the electrostatic latent image has been recorded on photoconductive surface 12, belt 10 advances the latent image to a development station C, which includes four developer units containing c m y k toner, in the form of liquid or dry particles, is electrostatically attracted to the latent image using commonly known techniques. The latent image attracts toner particles from the carrier granules forming a toner powder image thereon. As successive electrostatic latent images are developed, toner particles are depleted from the developer material. A toner particle dispenser, indicated generally by the reference numeral 44, dispenses toner particles into developer housing 46 of developer unit 38.

With continued reference to FIG. 1, after the electrostatic latent image is developed, the toner powder image present on belt 10 advances to transfer station D. A print sheet 48 is advanced to the transfer station D, by a sheet feeding apparatus 50. Preferably, sheet-feeding apparatus 50 includes a feed roil 52 contacting the uppermost sheet of stack 54. Feed roll 52 rotates to advance the uppermost sheet from stack 54 to vertical transport 56. Vertical transport 56 directs the advancing sheet 48 of support material into registration transport 57 past image transfer station D to receive an image from photoreceptor belt 10 in a timed sequence so that the toner powder image formed thereon contacts the advancing sheet 48 at transfer station D. Transfer station D includes a corona-generating device 58, which sprays ions onto the backside of sheet 48. This attracts the toner powder image from photoconductive surface 12 to sheet 48. After transfer, sheet 48 continues to move in the direction of arrow 60 by way of belt transport 62, which advances sheet 48 to fusing station F.

Fusing station F includes a fuser assembly indicated generally by the reference numeral 70 which permanently affixes the transferred toner power image to the copy sheet. Preferably, fuser assembly 70 includes a heated fuser roller 72 and a pressure roller 74 with the powder image on the copy sheet contacting fuser roller 72. The pressure roller is crammed against the fuser roller to provide the necessary pressure to fix the toner powder image to the copy sheet. The fuser roll is internally heated by a quartz lamp (not shown). Release agent, stored in a reservoir (not shown), is pumped to a metering roll (not shown). A trim blade (not shown) trims off the excess release agent. The release agent transfers to a donor roll (not shown) and then to the fuser roll 72.

The sheet then passes through fuser 70 where the image is permanently fixed or fused to the sheet. After passing through fuser 70, a gate either allows the sheet to move directly via output 17 to a finisher or stacker, or deflects the sheet into the duplex path 100, specifically, first into single sheet inverter 82 here. That is, if the second sheet is either a simplex sheet, or a completed duplexed sheet having both side one and side two images formed thereon, the sheet will be conveyed via gate 88 directly to output 17. However, if the sheet is being duplexed and is then only printed with a side one image, the gate 88 will be positioned to deflect that sheet into the inverter 82 and into the duplex loop path 100, where that sheet will be inverted and then fed to acceleration nip 102 and belt transports 110, for recirculation back through transfer station D and fuser 70 for receiving and permanently fixing the side two image to the backside of that duplex sheet, before it exits via exit path 17.

After the print sheet is separated from photoconductive surface 12 of belt 10, the residual toner/developer and paper fiber particles adhering to photoconductive surface 12 are removed therefrom at cleaning station E. Cleaning station E includes a rotatably mounted fibrous brush in contact with photoconductive surface 12 to disturb and remove paper fibers and a cleaning blade to remove the nontransfered toner particles. The blade may be configured in either a wiper or doctor position depending on the application. Subsequent to cleaning, a discharge lamp (not shown) floods photoconductive surface 12 with light to dissipate any residual electrostatic charge remaining thereon prior to the charging thereof for the next successive imaging cycle.

Controller 29 regulates the various machine functions. The controller is preferably a programmable microprocessor, which controls all of the machine functions hereinbefore described. The controller provides a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by the operator. Conventional sheet path sensors or switches may be utilized to keep track of the position of the document and the copy sheets.

Figure 2:
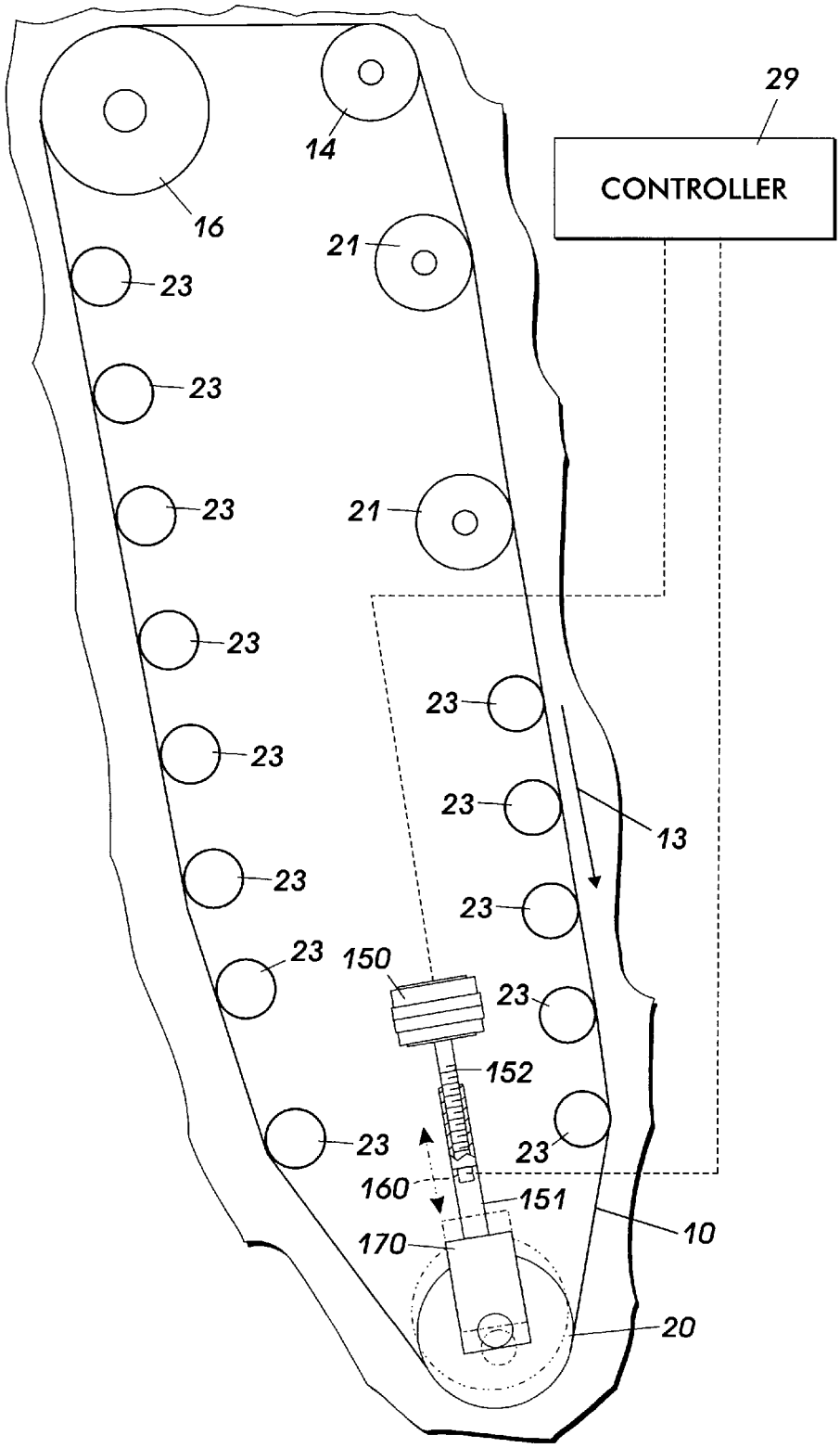
FIG. 2 illustrates a photoreceptor belt in an expanded, tensioned, run position.

Referring now to the subject matter of the present invention, FIG. 2 depicts the photoreceptor belt 10 in a tensioned image receiving position as it is entrained around drive roll 16, tension steering roll 20, idler rolls 21, and stripping roll 14. Various sized backer bars 23 are stationary and serve to position and guide belt 10. A controller 29 controls actuation of a conventional stepper motor 150 in order to precisely tension photoreceptor belt 10 into a run or image receiving position. Controller 29 has been programmed to apply a predetermined tension standard amount against tension roll 20 and thus against photoreceptor belt 10. A conventional load cell 160 is positioned within housing portion of piston actuator 170 and measures the tension applied against photoreceptor belt 10. Stepper motor 150 is actuated by controller 29 to apply tension to piston actuator 170 or relieve tension from the yoke depending on whether tension on photoreceptor belt 10 is to be increased or decreased. It should be understood that the tension can be applied at any movable roll or bar and is not restricted to the site where the tension is measured.

In operation, a predetermined amount of tension is placed on photoreceptor belt 10 through the actuation of stepper motor 150. Stepper motor 150 applies tension to photoreceptor belt 10 through pressure on load cell 160 and piston actuator 170. Load cell 160 measures the pressure on photoreceptor belt 10 and signals controller 29 to stop the stepper motor once a predetermined pressure on photoreceptor 10 has been reached. If the pressure on photoreceptor 10 measured by load cell 160 decreases a signal is sent to controller 29 which in turn actuates the stepper motor until load cell 160 reaches the predetermined pressure setting.

In FIG. 2, load cell 160 is shown mounted within piston actuator applied to the load cell by lead screw 152 as it is rotated in the direction of the arrows by stepper motor 150 to increase or decrease force against piston actuator 170 and in turn against tension roll 20. The horizontal force being exerted on the load cell by piston actuator 170 is proportional to the belt tension.

Preferably, the position of tension roll 20 is obtained by driving lead screw 152 backwards until zero load is detected on load cell 160 which is a home position. The correct photoreceptor belt tension is then obtained by moving tension roll 20 outwards into photoreceptor belt 10 from the initial home position until the predetermined photoreceptor belt tension is reached. Microprocessor based controller 29 maintains appropriate force against tension roll 20 to achieve required constant photoreceptor belt tension.

It should now be apparent that a closed loop belt tension system has been disclosed that sets and monitors a photoreceptor belt to improve drive capacity if friction is reduced between the photoreceptor belt and a drive roll decreases during operation as sensed by a sensor mounted on a shaft supporting the drive roll.

While the invention has been described with reference to the structure herein disclosed, it is not confined to the details as set forth and is intended to cover any modification and changes that may come within the scope of the following claims.

What is claimed is:

1. A belt tensioning apparatus, comprising:

a closed loop belt;

a steering roll over which said belt is mounted for rotation;

a piston actuator drivingly connected to said steering roll to apply pressure to said steering roll;

a load cell positioned to contact said piston actuator;

a stepper motor movably connected to said piston actuator for moving said piston actuator to apply pressure to or relieve tension from said belt, said stepper motor including a lead screw positioned to contact said load cell during actuation of said stepper motor; and a controller for controlling said stepper motor in accordance with signal output from said load cell generated by said load cell in response to movement of said piston actuator by said stepper motor.

2. A belt tensioning apparatus, comprising:

a closed loop belt;

a plurality of rolls over which said belt is mounted for rotation;

a piston actuator movably connected to one of said rolls to apply pressure to said one of said rolls;

a load cell positioned to contact said piston actuator;

a stepper motor movably connected to said piston actuator for moving said piston actuator to apply pressure to or relieve tension from said one of said rolls and thereby apply pressure to or relieve tension from said belt, said stepper motor including a lead screw positioned to contact said load cell during actuation of said stepper motor; and a controller for controlling said stepper motor in accordance with signal output from said load cell generated by said load cell in response to movement of said piston actuator by said stepper motor.

* * * * *